United States Patent [19]

Wolf

[11] Patent Number: 4,903,389

[45] Date of Patent: Feb. 27, 1990

[54] HEAT EXCHANGER WITH LAMINATED HEADER AND METHOD OF MANUFACTURE

[75] Inventor: Peter G. Wolf, Tonawanda, N.Y.

[73] Assignee: General Motors Corporation, Detroit, Mich.

[21] Appl. No.: 200,321

[22] Filed: May 31, 1988

[51] Int. Cl.[4] ..... F28B 1/00

[52] U.S. Cl. ..... 29/890.43; 29/890.046; 165/153; 165/175

[58] Field of Search ..... 29/157.3 R, 157.3 B; 165/153, 158, 173, 175, 178

[56] References Cited

U.S. PATENT DOCUMENTS 2,295,087 9/1942 Kleucker .
3,237,688 3/1966 Huggins .
3,310,869 3/1967 Porte et al. .
3,675,710 7/1972 Ristow .

FOREIGN PATENT DOCUMENTS 0022234 1/1981 .

*Primary Examiner*—Gerald A. Michalsky
*Attorney, Agent, or Firm*—R. L. Phillips

[57] ABSTRACT

A tube and center heat exchanger has headers formed of three flat plates stacked and bonded together. One plate has apertures for receiving the tube ends, the second plate is a spacer and has partitions defining passages for fluid flow from one tube to another, and the third plate is an end cap to enclose the passages and may include inlet and/or outlet ports. The flat plates are stamped from flat sheet stock of braze clad aluminum, the necessary perforations are stamped out and the plates are stacked and riveted into header subassemblies. The tube and center elements are assembled and the tube ends are inserted into the header subassemblies. The whole condenser is brazed to form the bonding between the plates as well as the other elements.

8 Claims, 2 Drawing Sheets

HEAT EXCHANGER WITH LAMINATED HEADER AND METHOD OF MANUFACTURE

FIELD OF THE INVENTION

This invention relates to heat exchangers and the method of manufacture thereof and particularly with respect to heat exchangers having laminated headers.

BACKGROUND OF THE INVENTION

Tube and center heat exchangers commonly have a plurality of parallel flat extruded tubes coupled at each end to a header and air centers between the tubes to facilitate efficient heat transfer to the surrounding air. The headers generally comprise a header plate with tube receiving apertures and a tank secured to the plate to supply working fluid to and receive fluid from the tubes. The tubes are brazed or otherwise bonded to the plates to assure leak free joints. The tank is also assembled to the plate in a leak free manner. The U.S. Pat. No. 3,310,869 to La Porte et al reveals this type of heat exchanger. There, each header plate and tank is integrally formed of a single sheet of material curved into a flat sided cylinder and brazed or crimped along a seam. The U.S. Pat. No. 3,675,710 to Ristow shows a condenser having tubes connected to headers fabricated from sheet stock welded or brazed together. Individual partitions welded crosswise between the interior walls of the header control the fluid flow path in the condenser. The placing of the partitions determines the number of passes of fluid across the condenser core and the number of tubes in each pass.

Structural improvements in such condensers or other heat exchangers are desired to enhance the ease of manufacture and reduce the cost while maintaining or improving durability and reliability. Design goals include improved burst pressure and low tooling cost. Design flexibility is also important to allow selection of the number of passes etc. with a minimal change in the structure and the manufacturing process.

SUMMARY OF THE INVENTION

It is therefore an object of the invention to provide an improved heat exchanger structure which is easy to fabricate and is flexible in design.

It is another object to provide an improved method of manufacture of a heat exchanger.

The invention is carried out by a heat exchanger having a plurality of parallel tubes for carrying a working fluid and a header at each end of the tubes for directing the working fluid through the tubes in a desired flow path, each header comprising; a flat inner plate apertured for receiving an end of each of the plurality of tubes and serving as one side of a passage means, an outer plate aligned with and spaced from the inner plate and serving as a second side of the passage means, and a flat spacer conforming to and bonded between the margins of the inner plate and the outer plate to form the remaining boundaries of the passage means, the thickness of the spacer defining the spacing of the inner and outer plates to provide at least one flow passage connecting the tube ends.

The invention is also carried out by the method of manufacturing a heat exchanger having a pair of headers connected by a plurality of parallel tubes comprising the steps of: for each header, stamping a flat header plate, an outer plate and a flat spacer from flat stock and providing tube receiving apertures in the plate and one or more openings in the spacer, stacking the header plate and the outer plate with the spacer interposed to form passage means in the spacer openings between the plates, and mechanically securing the stacked plates and spacer into a header subassembly; connecting a plurality of tubes to the headers by inserting tube ends into the apertures of the header plates; assembling air centers between the tubes; and brazing the whole assembly to bond the parts at each joint.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE PREFERRED EMBODIMENT

While the ensuing description is directed to a condenser for an automotive air conditioner, the invention clearly applies to other heat exchangers as well.

Figure 1:
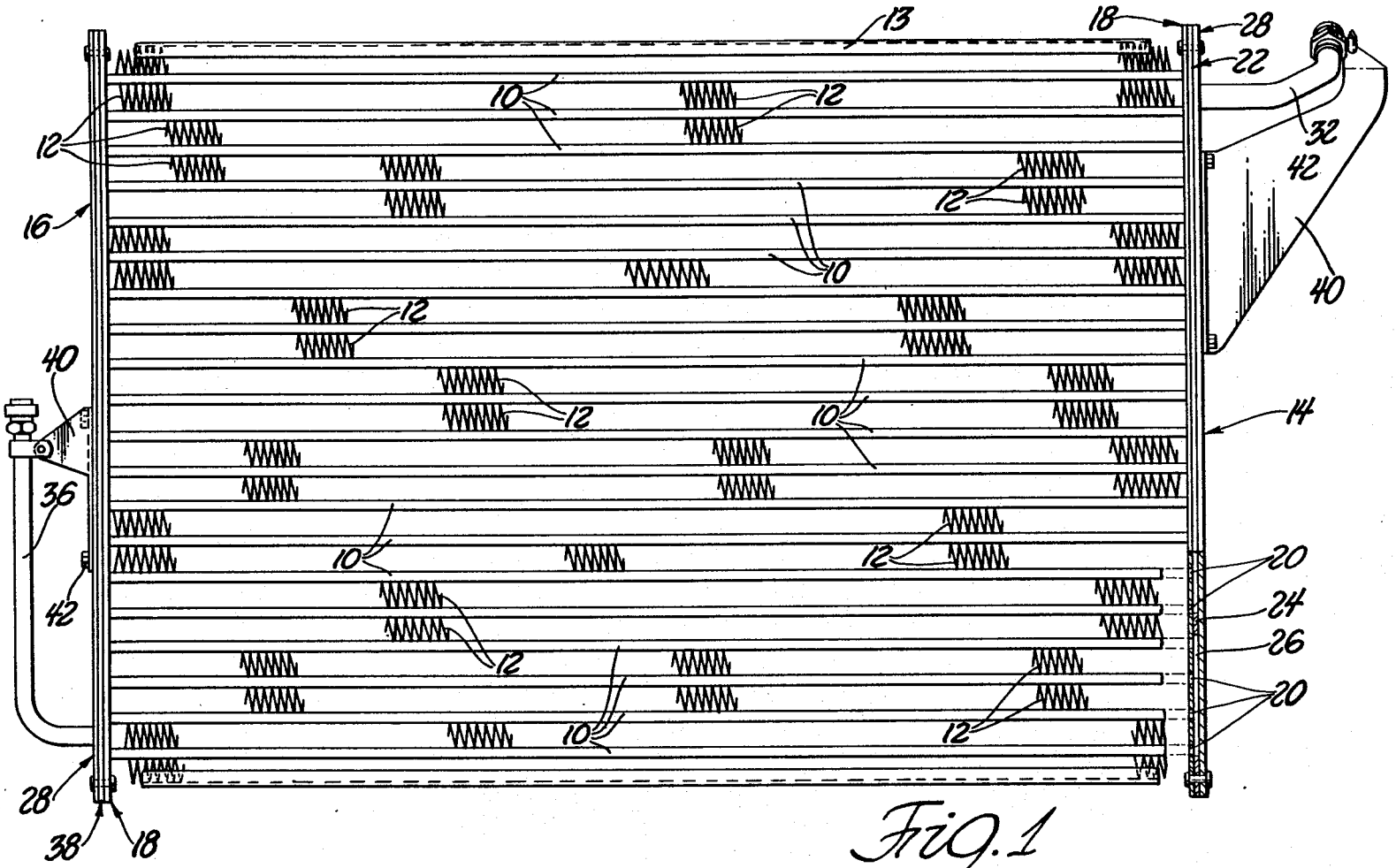
FIG. 1 is a front view of a condenser having laminated headers according to the invention.

Referring to FIG. 1, a condenser comprises a plurality of flat extruded tubes 10 arranged in parallel configuration and joined by air centers 12 which are zigzag elements for thermal coupling of the tubes with the ambient air. Reinforced side plates 13 engage the outermost air centers 12. The ends of the tubes 10 are connected to headers 14 and 16.

Figure 2:
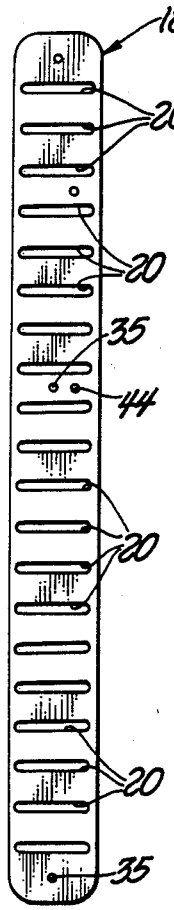
FIG. 2 is a side view of a header plate for the laminated headers of FIG. 1.
Figure 3:
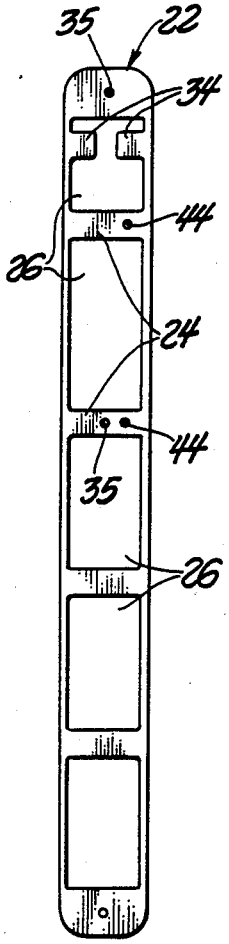
FIG. 3 is a side view of a header spacer of one of the laminated headers of FIG. 1.
Figure 4:
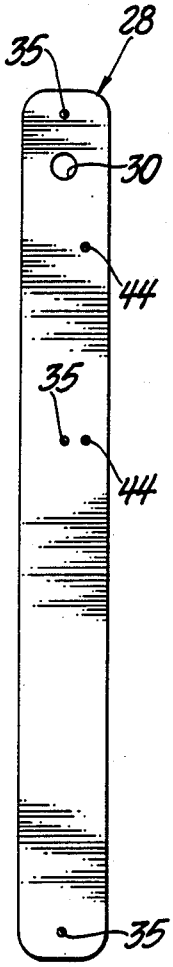
FIG. 4 is a side view of an outer plate of one of the laminated headers of FIG. 1.

The header 14 is formed of three laminated plates (shown in FIGS. 2, 3 and 4): a header plate 18 having apertures 20 for receiving the tubes 10, a spacer plate 22 having partitions 24 defining openings 26 and an outer plate or cap 28 having an inlet port 30 for receiving a tube 32. The plates preferably are thick, say 3.2 mm, so that secure connections can be made with the tubes 10 and the tube 32 to achieve high burst pressure capability. The thick spacer plate 22 determines the size of flow passages interconnecting the tubes 10. Fingers 34 extend inwardly from the margins of the spacer plate into an opening 26 in the region of the port 30 to provide a stop for proper positioning of the tube 32. The width of the openings 24 is slightly less than the width of the tubes 10 so that the spacer 22 serves as a stop for proper positioning of the tubes 10 upon assembly of the tubes and headers. Each plate contains three spaced holes 35 for rivets.

Figure 5:
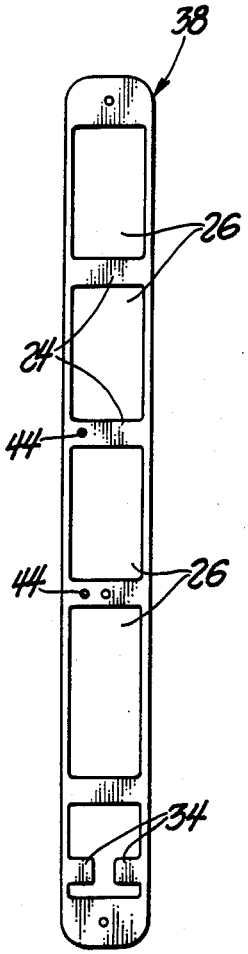
FIG. 5 is a side view of a header spacer of the other of the laminated headers of FIG. 1.

The header 16 is the same as the header 14 except that the outlet tube 36 is positioned at the opposite end of the condenser from the inlet and the spacer plate 38 shown in FIG. 5 is used. The fingers 34 are at the same end as the outlet tube 36. The spacer plate 38 further differs from the spacer 22 in that the partitions 24 of spacer 38 are staggered relative to the partitions in spacer 22 so that cooperatively they define the flow path through the condenser. The partitions can be omitted to yield one large opening 26 in each spacer to provide a single pass condenser. At the other extreme the partitions can be so close that only a single tube per pass is used. Of course, if an even number of passes is chosen the outlet and inlet ports will be in the same header. Thus the characteristics of different condenser models can be designed by the selection of the partition positions thereby giving flexibility in design. Brackets 40 for supporting the outlet and inlet tubes are secured to the headers by fasteners 42 threaded into holes 44 at the partitions.

Conventional aluminum heat exchanger materials are employed so that conventional brazing can be used. All the parts comprise a base material of aluminum 3003 and at least the header plate 18, the outer plate 28 and the centers 12 are clad with aluminum 4343 which serves as brazing material. Alternatively, other alloy combinations appropriate to the intended brazing process may be used.

The manufacture of the condenser comprises extruding the flat tubes 10 and cutting them to size, and forming the zigzag air centers 12 from 0.0045 to 0.006 inch thick stock. The tubes 10 and centers 12 and the reinforced side plates 13 are assembled and mechanically held together to form a core subassembly. The plates 18, 22, 28 and 36 are stamped from flat aluminum sheet stock about 3.2 mm thick and the various perforations are also formed by stamping. The plate may be stamped from the same stock when the same thickness and braze cladding are desired. The resulting plates are flat and make intimate contact with one another when assembled. The plates are stacked with the spacer plate 22 or 36 between the header plate 18 and the outer plate 28 and they are mechanically joined into a subassembly by rivets through the holes 35. Then the header subassemblies are coupled to the core subassembly by inserting the tube ends into the apertures 20 in the header plates. The inlet and outlet tubes 32, 36 are inserted into the corresponding ports. All the tubes abut the inner edges of the spacer 22 to prevent the intrusion of a tube into an opening 26. The entire condenser is brazed in one operation by a conventional brazing process comprising spraying the condenser with a fluoride flux and heating it to 1100 degrees F. in a brazing furnace. Other joining processes such as vacuum brazing may be used.

It will thus be seen that according to the invention an improved heat exchanger structure using laminated headers and the method of making it provide a flexible design which has high burst pressure capability and is easy to manufacture. Variations from the described embodiment may occur within the teaching of the invention. For example, the outer plate may be slightly dished outwardly in the regions between the partitions to increase its ability to withstand internal pressure while maintaining its sealing contact with the spacer.

The embodiments of the invention in which an exclusive property or privilege is claimed are defined as follows:

1. A heat exchanger having a plurality of parallel tubes for carrying a working fluid and a header at each end of the tubes for directing the working fluid through the tubes in a desired flow path, each header comprising;

a flat inner plate apertured for receiving an end of each of the plurality of tubes and serving as one side of a passage means, an outer plate aligned with and spaced from the inner plate and serving as a second side of the passage means, and a flat spacer conforming to and bonded between the margins of the inner plate and the outer plate to form the remaining boundaries of the passage means, the thickness of the spacer defining the spacing of the inner and outer plates to provide at least one flow passage connecting the tube ends.

2. The invention as defined in claim 1 wherein the flat spacer includes at least one partition extending across the space between the inner and outer plates to define plural flow passages connecting the tube ends, the partitions in the two headers being staggered to yield a serpentine flow path through the condenser.

3. The invention as defined in claim 1 wherein the outer plate includes at least one aperture to serve as an inlet or outlet port for working fluid.

4. The method of manufacturing a heat exchanger having a pair of headers connected by a plurality of parallel tubes comprising the steps of:

for each header, stamping a flat header plate, an outer plate and a flat spacer from flat sheet stock and providing tube receiving apertures in the plate and a selected number of openings in the spacer less in number than the plate apertures, stacking the header plate and the outer plate with the spacer interposed to form passages means in the spacer openings between the plates, and mechanically securing the stacked plates and spacer into a header subassembly;

connecting a plurality of tubes to the headers by inserting tube ends into the apertures of the header plates;

assembling air centers between the tubes; and brazing the whole assembly to bond the parts at each joint.

5. The invention as defined in claim 4 wherein during assembly each opening in the spacer is selectively aligned with at least two of the apertures in the header plate to define a flow path.

6. The invention as defined in claim 4 wherein the openings in the spacers are narrower than the width of the tubes so that upon insertion of the tubes into the apertures the spacers prevent tube insertion into the openings.

7. The invention as defined in claim 4 wherein the header plate, the flat outer plate and the flat spacer are stamped from the same sheet stock.

8. The invention as defined in claim 4 wherein the header plate and the outer plate are stamped from braze clad sheet stock.

* * * * *